US010712075B2

(12) United States Patent
Zhang et al.

(10) Patent No.: US 10,712,075 B2
(45) Date of Patent: Jul. 14, 2020

(54) REFRIGERATOR AND VENTILATION DOOR DEVICE THEREOF

(71) Applicant: QINGDAO HAIER JOINT STOCK CO., LTD., Qingdao, Shandong Province (CN)

(72) Inventors: Hao Zhang, Qingdao (CN); Enpin Xia, Qingdao (CN); Huimin Zhang, Qingdao (CN); Xiaobing Zhu, Qingdao (CN)

(73) Assignee: QINGDAO HAIER JOINT STOCK CO., LTD., Qingdao, Shandong Province (CN)

( * ) Notice: Subject to any disclaimer, the term of this patent is extended or adjusted under 35 U.S.C. 154(b) by 108 days.

(21) Appl. No.: 15/770,200

(22) PCT Filed: Jun. 8, 2016

(86) PCT No.: PCT/CN2016/085343
§ 371 (c)(1),
(2) Date: Apr. 21, 2018

(87) PCT Pub. No.: WO2017/067186
PCT Pub. Date: Apr. 27, 2017

(65) Prior Publication Data

US 2018/0306481 A1 Oct. 25, 2018

(30) Foreign Application Priority Data

Oct. 23, 2015 (CN) ..... 2015 1 0696931

(51) Int. Cl.
*F25D 17/04* (2006.01)
*F25D 11/00* (2006.01)
*F25D 17/06* (2006.01)

(52) U.S. Cl.
CPC ..... *F25D 17/045* (2013.01); *F25D 11/00* (2013.01); *F25D 17/062* (2013.01)

(58) Field of Classification Search
CPC .... F25D 17/045; F25D 17/065; F25D 17/062; F25D 2317/0413; F25D 2317/0672; F25D 29/005
See application file for complete search history.

(56) References Cited

U.S. PATENT DOCUMENTS

2006/0005567 A1* 1/2006 Lee ..... F25D 17/045 62/408
2012/0146477 A1* 6/2012 Bischofberger ..... F25D 25/025 312/404

FOREIGN PATENT DOCUMENTS

CN 201251338 Y 6/2009
CN 104075520 A 10/2014
(Continued)

*Primary Examiner* — Elizabeth J Martin
(74) *Attorney, Agent, or Firm* — Cheng-Ju Chiang

(57) ABSTRACT

A refrigerator and ventilation door device thereof are provided. The ventilation door device comprises: a bottom frame provided with a ventilation opening; a door plate disposed abutting the bottom frame, configured to shift in a parallel plane of the bottom frame so as to adjust an area of the ventilation opening, and a guideway forming a predetermined angle with respect to the shifting direction of the door plate; and an adjuster having a guide post movably inserted in the guideway, and upon moving of the adjuster in a direction perpendicular to the shifting direction of the door plate, the guide post drives the door plate to shift.

14 Claims, 4 Drawing Sheets

(56) References Cited

FOREIGN PATENT DOCUMENTS

| | | | | |
|---|---|---|---|---|
| CN | 104764270 | A | | 7/2015 |
| CN | 204478637 | U | | 7/2015 |
| CN | 105222457 | A | | 1/2016 |
| JP | 2004061085 | A | * | 2/2004 |

* cited by examiner

REFRIGERATOR AND VENTILATION DOOR DEVICE THEREOF

CROSS REFERENCE TO RELATED APPLICATIONS

The present application is a 35 U.S.C. § 371 National Phase conversion of International (PCT) Patent Application No. PCT/CN2016/085343, filed on Jun. 8, 2016, which further claims benefit of Chinese Patent Application No. 201510696931.4, filed on Oct. 23, 2015, the disclosure of which is incorporated by reference herein. The PCT International Patent Application was filed and published in Chinese.

FIELD OF THE INVENTION

The present invention relates to a refrigerator-freezer, and in particular, to a refrigerator and a ventilation door device thereof.

BACKGROUND OF THE INVENTION

An air-cooled refrigerator is generally provided with an air channel, and a cooling compartment for placing an evaporator. Cooling air in the cooling compartment is delivered to each storage compartment by a fan via the air channel. The temperature of the storage compartment is adjusted by controlling the flow rate of the cooling air delivered to the storage compartment.

In order to adjust the flow rate of the cooling air, an electric air door is usually disposed in the air channel. The electric air door is accurate in adjustment and high in controllability, but relatively high in cost, complicated in structure and cumbersome in control, and consumes a certain amount of electrical energy during use.

SUMMARY OF THE INVENTION

An objective of a first aspect of the present invention is to solve one of the above-mentioned defects in the prior art by providing a ventilation door device which has a simple structure, is convenient to operate, and consumes no electrical energy.

An objective of a second aspect of the present invention is to provide a refrigerator using the ventilation door device.

According to the first aspect of the present invention, the present invention provides a ventilation door device for a refrigerator. The ventilation door device comprises: a bottom frame provided with a ventilation opening; a door plate abutting against the bottom frame, configured to shift along a parallel plane of the bottom frame so as to adjust an area of the ventilation opening shielded by the door plate, and having, at a side opposing the bottom frame, a guideway formed at a predetermined angle with respect to the shifting direction of the door plate; and an adjuster having a guide post protruding toward the guideway, wherein the guide post is movably embedded in the guideway, such that the guide post drives the door plate to shift when the adjuster moves in a direction perpendicular to the shifting direction of the door plate.

Optionally, sliding grooves are disposed on a group of opposite side edges of the bottom frame to accommodate the edges of the door plate.

Optionally, the ventilation door device further comprises: a front panel which is fixed on the side edge, perpendicular to the sliding groove, of the bottom frame, is perpendicular to the bottom frame and is provided with a guide opening parallel to the bottom frame; in addition, the adjuster penetrates through the guide opening, such that a movement direction of the adjuster is defined by the guide opening.

Optionally, the adjuster is disposed perpendicularly to the guide opening, and has a first end provided with the guide post, and a second end extending out of the front panel.

Optionally, the second end of the adjuster is provided with a handle portion abutting against the front panel.

Optionally, a make-way opening that allows the guide post of the adjuster to pass through is disposed at one end of the guide opening.

Optionally, the ventilation opening is rectangular, and the door plate is rectangular and has an area larger than that of the ventilation opening; in addition, the ventilation door device is configured to completely seal the ventilation opening when the guide post moves to the first end of the guideway, and a ventilation area of the ventilation opening is gradually increased when the guide post moves from the first end of the guideway toward the second end thereof.

Optionally, the guideway extends in a straight line inclined with respect to all side edges of the door plate.

Optionally, the surface of the door plate protrudes outwards to form a wall of the guideway.

According to the second aspect of the present invention, the present invention further provides a refrigerator, which comprises a storage compartment and an air channel for delivering cooling air to the storage compartment, and further comprises at least one of the ventilation door devices described above, wherein a bottom frame is disposed in the air channel, and the flow rate of the cooling air in the air channel is adjusted by adjusting the ventilation area of the ventilation opening.

According to the refrigerator and the ventilation door device thereof of the present invention, the bottom frame provided with the ventilation opening and the door plate abutting against the bottom frame are arranged, such that the ventilation area of the ventilation opening may be adjusted by a shifting movement of the door plate. In order to realize the shifting of the door plate, the ventilation door device is further provided with the adjuster through which the guide post cooperates with the guideway disposed obliquely on the door plate. The guide post drives the door plate to shift in a direction perpendicular to the movement direction of the adjuster when the adjuster moves, thereby adjusting the ventilation area. The ventilation door device of the present invention has an ingenious structure and is convenient to adjust.

Further, the ventilation door device of the present invention reasonably limits the movement of an air door and makes the adjustment process more accurate and reliable by means of the sliding grooves, the guide opening, the handle portion and other structures.

Further, according to the ventilation door device of the present invention, the ventilation opening and the door plate are both set to be rectangular, and the guideway extends along a straight line, so that the change value of the ventilation area is in linear relationship with the displacement of the adjuster, which is convenient for a user to accurately adjust the ventilation area.

Further, in the ventilation door device of the present invention, the surface of the door plate protrudes outwards to form a wall of the guideway, rather than being recessed inwardly from the surface of the door plate, such that the thickness of the door plate can be reduced as much as possible, thereby reducing the mass of the door plate and making the adjustment process more labor-saving.

The above and other objectives, advantages and features of the present invention will be understood by those skilled in the art more clearly with reference to the detailed description of the specific embodiments of the present invention below in conjunction with the accompanied drawings.

BRIEF DESCRIPTION OF THE DRAWINGS

The followings will describe some specific embodiments of the present invention in detail in an exemplary rather than restrictive manner with reference to the accompanying drawings. The same reference signs in the drawings represent the same or similar parts. Those skilled in the art shall understand that these drawings may not be necessarily drawn according to the scales. In the drawings.

DETAILED DESCRIPTION OF THE EMBODIMENTS

Figure 1:
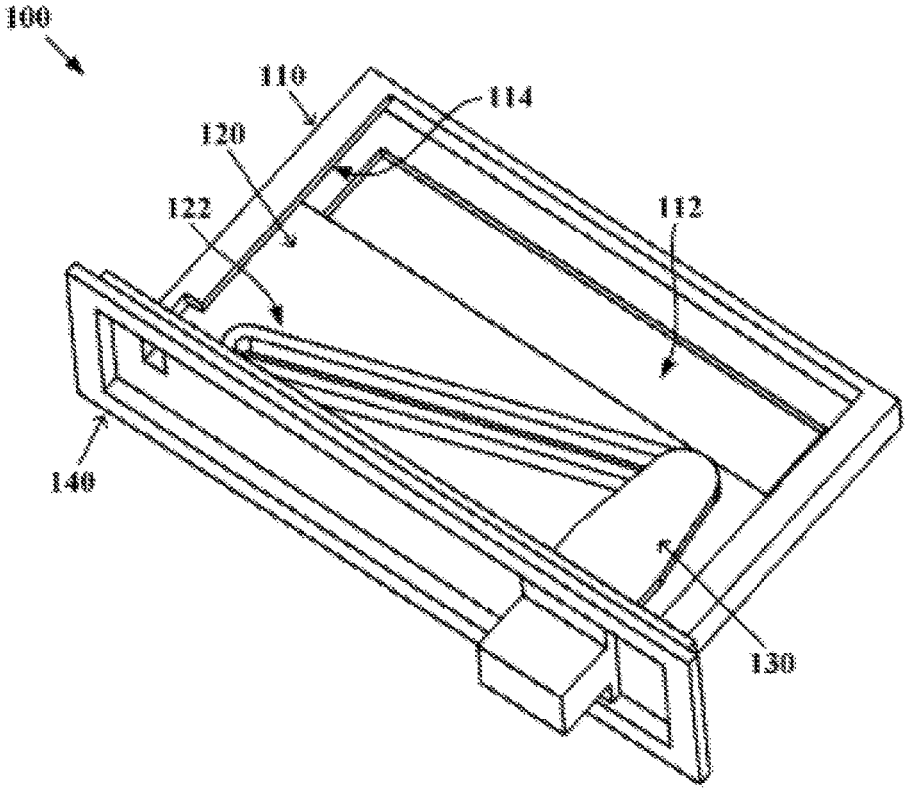
FIG. 1 is a schematic assembly view of a ventilation door device for a refrigerator according to an embodiment of the present invention.
Figure 2:
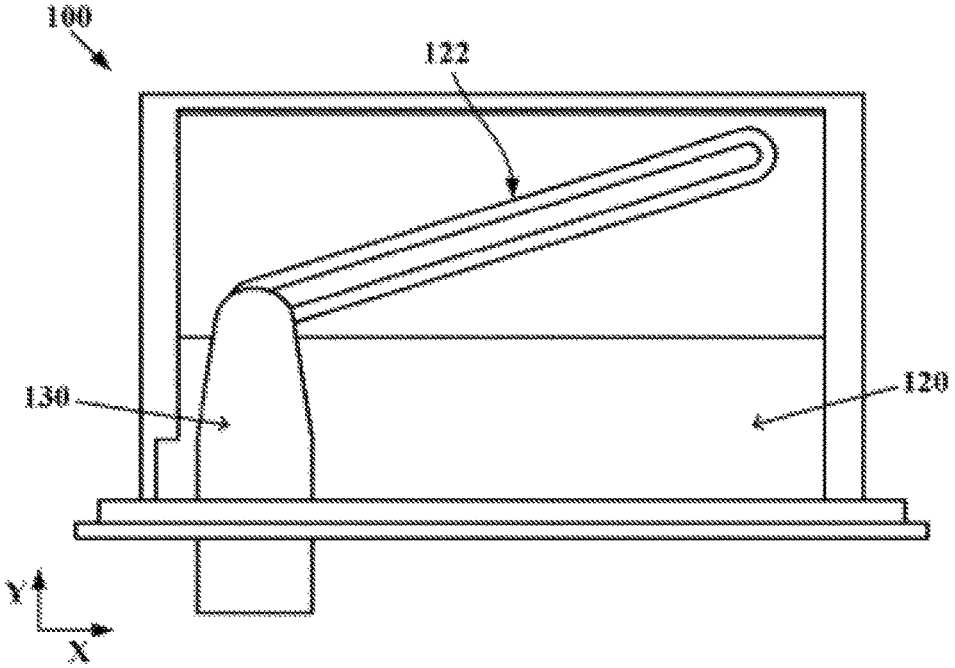
FIG. 2 is a schematic view of the ventilation door device shown in FIG. 1 when the ventilation opening is completely shielded.
Figure 3:
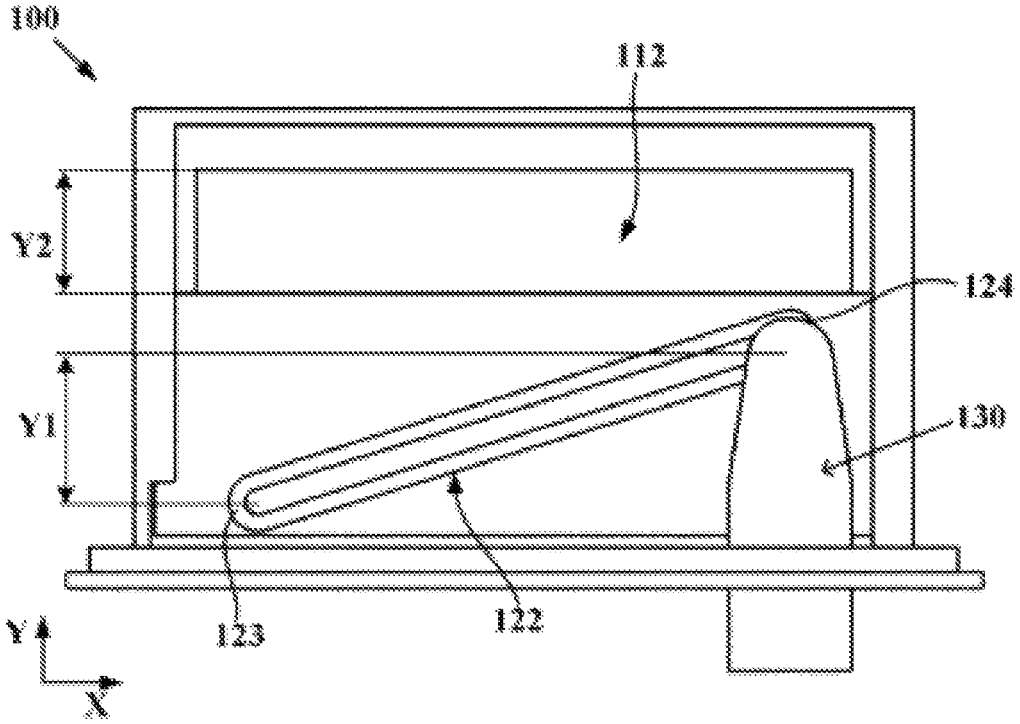
FIG. 3 is a schematic view of the ventilation door device shown in FIG. 1 when the ventilation opening is completely opened.
Figure 4:
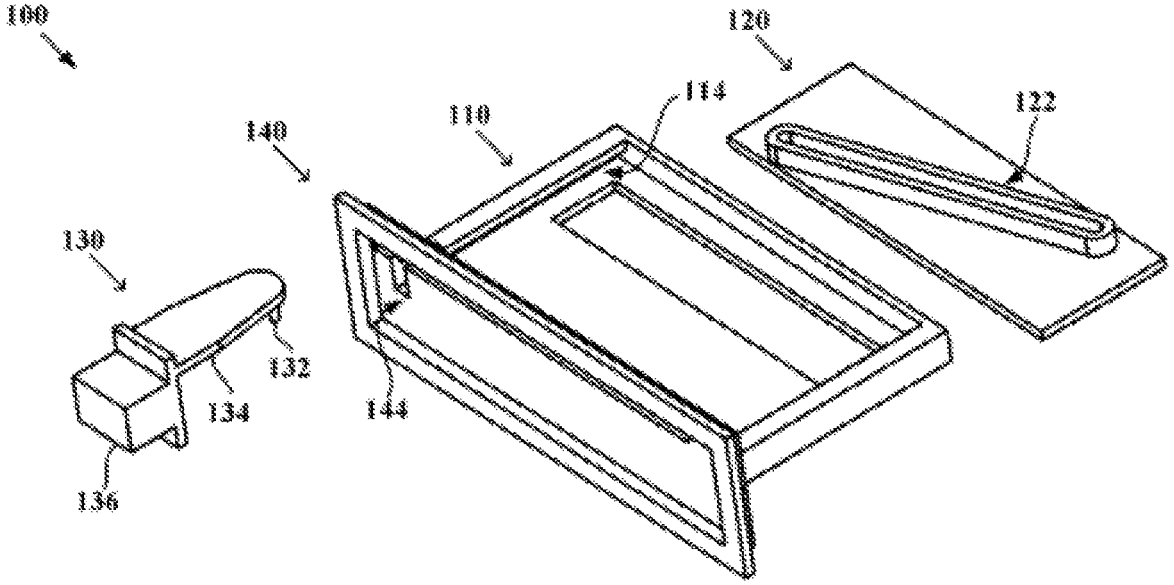
FIG. 4 is an exploded schematic view of the ventilation door device shown in FIG. 1.

FIG. 1 is a schematic assembly view of a ventilation door device for a refrigerator according to an embodiment of the present invention. FIG. 2 is a schematic view of the ventilation door device shown in FIG. 1 when the ventilation opening is completely shielded. FIG. 3 is a schematic view of the ventilation door device shown in FIG. 1 when the ventilation opening is completely opened. FIG. 4 is an exploded schematic view of the ventilation door device shown in FIG. 1. As shown in FIGS. 1 to 4, the ventilation door device 100 may generally comprise a bottom frame 110 and a door plate 120. The bottom frame 110 is provided with a ventilation opening 112. The door plate 120 abuts against the bottom frame 110, and configured to shift along a parallel plane of the bottom frame 110 so as to adjust an area of the ventilation opening 112 shielded by the door plate in the shifting process. Those skilled in the art may realize that the parallel plane of the bottom frame 110 is a plane parallel to the bottom frame 110.

Referring to FIG. 2 and FIG. 3, the ventilation opening 112 may be disposed at the end portion of the bottom frame 110. The door plate 120 abuts against the upper surface of the bottom frame 110 and is capable of moving along a Y-axis. When the door plate 120 moves forwards along the Y-axis to gradually shield the ventilation opening 112, the ventilation area of the ventilation opening 112 decreases continuously till the door plate completely shields the ventilation opening 112 (as shown in FIG. 2). When the door plate 120 moves backwards along the Y-axis and away from the ventilation opening 112, the ventilation area of the ventilation opening 112 increases continuously till the ventilation opening 112 is completely opened (as shown in FIG. 3).

In order to facilitate a user to manually shift the door plate 120, the ventilation door device 100 of the present embodiment of the present invention is further provided with an adjuster 130 and a guideway 122 which cooperate with each other. The guideway 122 is formed at a side, opposing the bottom frame 110, of the door plate 120. The guideway 122 is disposed at a predetermined angle (e.g., 60 degrees) with the shifting direction (i.e., the Y-axis direction) of the door plate 120. In addition, the adjuster 130 is provided with a guide post 132 which protrudes toward the guideway 122. The guide post 132 is movably embedded in the guideway 122, such that the guide post 132 drives the door plate 120 to shift in the Y-axis direction when the adjuster 130 moves in a direction perpendicular to the shifting direction of the door plate 120 (the adjuster 130 can only move along an X-axis direction, but cannot shift in the Y-axis direction). Those skilled in the art should understand that in order to avoid a case that the guide post 132 cannot drive the door plate 120 to shift because of the frictional locking between a wall of the guideway 122 and the guide post 132, an included angle between the guideway 122 and the Y-axis should be as large as possible. The larger the included angle is, and the more labor-saving the movement process is.

In some embodiments, both the ventilation opening 112 and the door plate 120 may be set to be rectangular. An area of the door plate 120 should be larger than that of the ventilation opening 112, such that the door plate can completely shield of the ventilation opening 112. However, an extending angle of the guideway 122 is preferably set such that the distance between two ends (a first end 123 and a second end 124 shown in FIG. 3) of the guideway in the longitudinal direction of the guideway on the Y-axis is larger than or equal to the dimension of the ventilation opening 112 in the Y-axis direction, i.e., $Y1 \geq Y2$. Therefore, the guide post 132 can completely seal the ventilation opening 112 when moving to the first end 123 of the guideway 122. A ventilation area of the ventilation opening 112 gradually increases when the guide post 132 moves from the first end 123 of the guideway 122 toward the second end 124 thereof.

Preferably, in order to make the movement process of the adjuster 130 more labor-saving, the guideway 112 may extend in a direction of a straight line inclined with respect to all side edges of the door plate 120. In addition, in some embodiments, the guideway 122 may be formed by recessing inwardly from the surface of the door plate 120. To make the depth of the guideway 122 large enough to receive the guide post 132, the door plate 120 needs to have a sufficient thickness, which increases the difficulty of material selection and the manufacturing cost of the door plate 120 as well as the mass of the door plate 120, thereby making the adjustment process laborious. In this case, in the preferred embodiment of the present invention, a wall of the guideway 122 is formed by protruding outwards away from the surface of the door plate 120 (as shown in FIG. 4), so that the depth of the guideway 122 is not affected by the thickness of the door plate 120.

Figure 5:
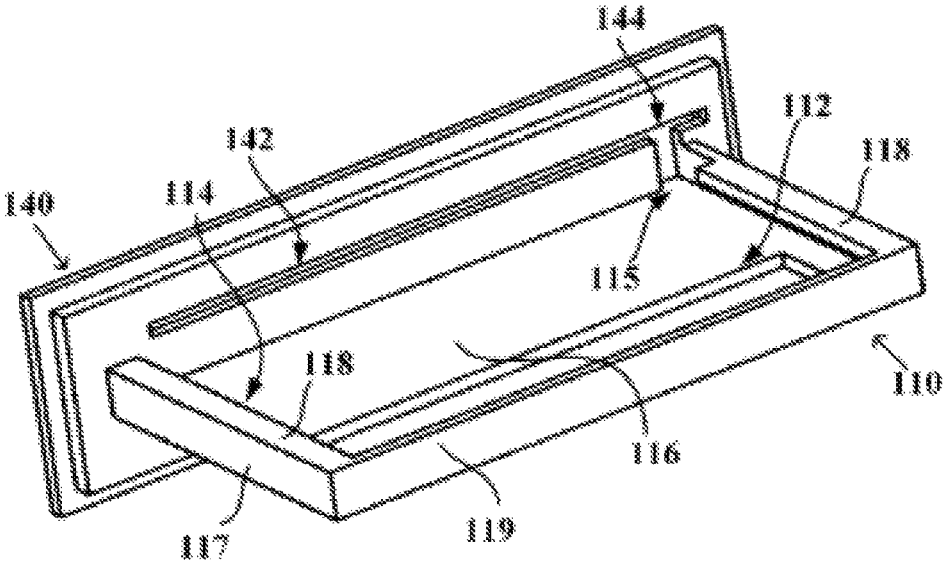
FIG. 5 is a structural schematic view of a bottom frame and a front panel of the ventilation door device shown in FIG. 1.

FIG. 5 is a structural schematic view of a bottom frame and a front panel in the ventilation door device shown in FIG. 1. As shown in FIGS. 1 to 5, when the guide post 132 shifts along the X-axis, an acting force of the guide post 132 on the guideway 122 is perpendicular to the wall of the guideway 122. A component of the acting force on the Y-axis will push the guideway 122 (thus driving the door plate 120) to shift in the Y-axis direction, and a component of the acting force on the X-axis should be offset by an acting force of the bottom frame 110 on the guideway 122, such that the door plate 120 can only shift in the Y-axis direction. Therefore, two opposite sliding grooves 114 may be disposed on a group of opposite side edges (i.e., two side edges perpendicular to the X-axis) of the bottom frame 110 to accommodate the edges of the door plate 120, thereby defining a movement direction of the door plate 120.

The specific structure of the bottom frame 110 may refer to FIG. 5, which may include a base plate portion 116, flanged portions 117 respectively extending from two sides of the base plate portion 116 toward one side thereof, and bent portions 118 respectively extending from the end portion of the flanged portion 117 toward the inner direction of the bottom frame 110. The base plate portion 116, the flanged portions 117 and the bent portions 118 together define the above-mentioned sliding grooves 114. In some embodiments, one side edge (i.e., the side edge perpendicular to the sliding groove 114) of the base plate portion 116 near the ventilation opening 112 is also provided with a connecting portion 119 which extends toward one side of the base plate portion 116 and is connected between the flanged portions 117 and the bent portions 118 at two sides.

In some embodiments, the ventilation door device 100 further comprises a front panel 140 which is fixed on a side edge, perpendicular to the sliding groove 114, of the bottom frame 110. The front panel 140 is perpendicular to the bottom frame 110 (i.e., perpendicular to the XY panel) and provided with a guide opening 142 parallel to the bottom frame 110 (i.e., extending in the X-axis direction). The adjuster 130 penetrates through the guide opening 142, such that a movement direction of the adjuster 130 may be defined by the guide opening 142, and the adjustment adjuster 130 can only move along the X-axis. Further, the adjuster 130 may be disposed perpendicularly to the guide opening 142 (i.e., the adjuster 130 is disposed in the Y-axis direction), has a first end provided with the guide post 132, and a second end extending out of the front panel 140, such that the front panel 140 controls the adjuster 130 to move at one side opposing the bottom frame 110. In order to facilitate user's manual operations, the second end of the adjuster 130 may be provided with a handle portion 136 that abuts against the front panel 140 to restrict the freedom degree of the adjuster 130 in the Y-axis direction.

Specifically, the adjuster 130 may include a connecting plate 134 disposed in parallel with the door plate 120. The guide post 132 protrudes downwards from one end of the connecting plate 134. The handle portion 136 may be in a square shape, and is fixedly disposed at the other end of the connecting plate 134.

In some embodiments, as shown in FIG. 2 and FIG. 5, since the first end of the adjuster 130 is provided with the protrudent guide post 132, and two ends of the adjuster 130 are respectively arranged at two sides of the guide opening 142, one end of the guide opening 142 is provided with a make-way opening 144 that allows the guide post 132 of the adjuster 130 to pass through, in order to allow the first end (the end provided with the guide post 132) of the adjuster 130 to pass through the guide opening 142 from the outside of the front panel 140. At the same time, a wall of the sliding groove 114 of the bottom frame 110 is also provided with a notch 115 which is used for making way for the guide post 132.

Figure 6:
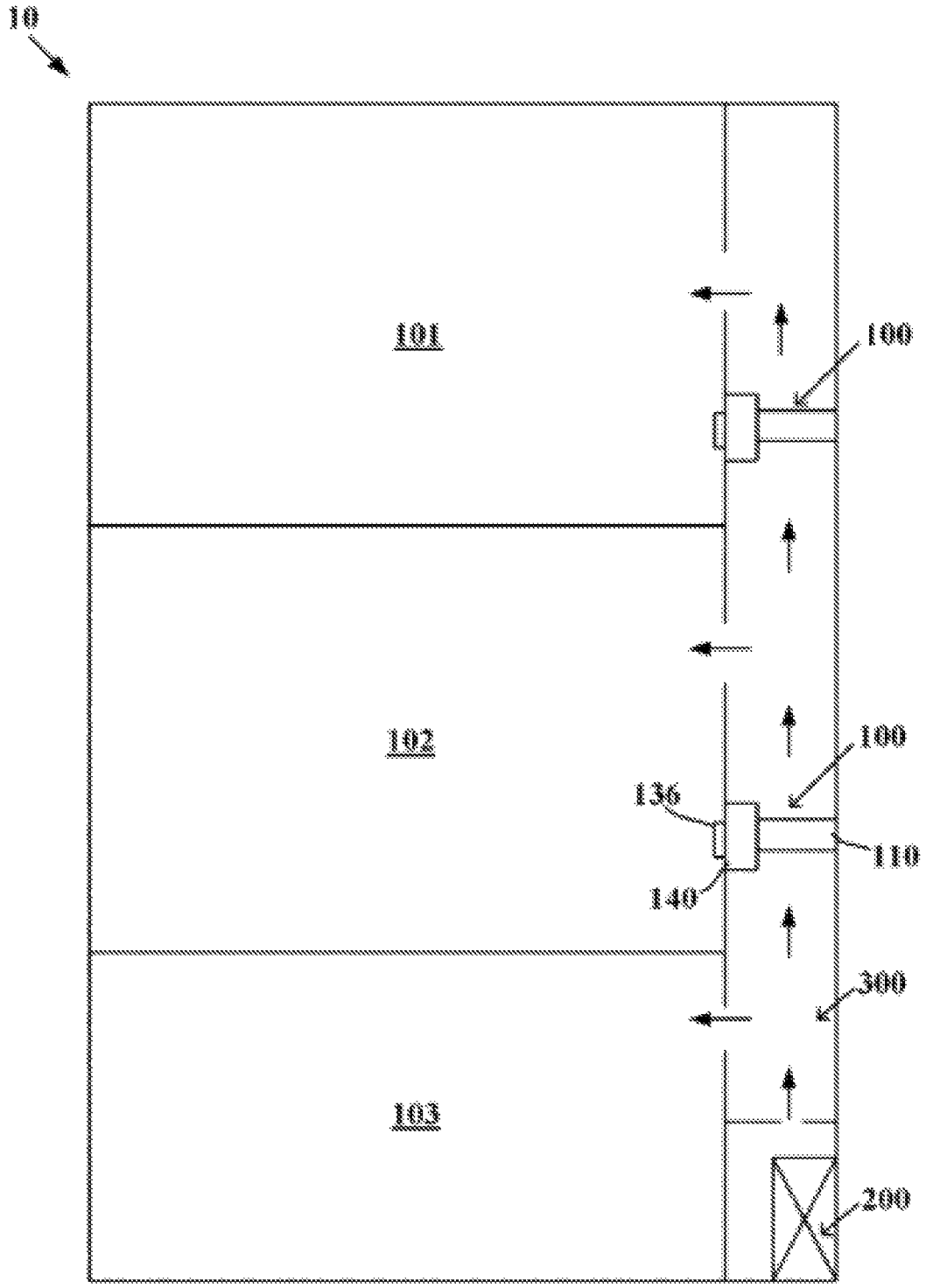
FIG. 6 is a structural schematic view of a refrigerator according to an embodiment of the present invention.

FIG. 6 is a structural schematic view of a refrigerator according to an embodiment of the present invention. As shown in FIG. 6, the air-cooled refrigerator 10 comprises storage compartments, an evaporator 200, an air channel 300 and at least one of the ventilation door devices 100 described above. There may be a plurality of storage compartments. The refrigerator 10 as shown in FIG. 6 comprises a storage compartment 101, a storage compartment 102 and a storage compartment 103. The air channel 300 communicates each storage compartment with the evaporator 200, such that cooling air prepared by the evaporator 200 is delivered to each storage compartment, to achieve a cooling purpose. Each ventilation door device 100 may adjust the flow rate of cooling air of the air channel 300 by adjusting a ventilation area of the ventilation opening 112, thereby adjusting the temperature of each storage compartment.

The air channel 300 may be disposed at the rear side of the refrigerator 10. The bottom frame 110 of the ventilation door device 100 is disposed inside the air channel 300 (it is possible to abut the front panel 140 against the inner wall of the air channel 300). The Y-axis is set in a front-back direction of the refrigerator 10, and the X-axis is set in a transverse direction of the refrigerator 10. In addition, the handle portion 136 of the adjuster 130 extends out of the air channel 300 and is exposed in the storage compartment, such that the door plate 120 moves in the front-back direction when a user moves the adjuster 130 in the transverse direction of the refrigerator 10, to change the ventilation area of the ventilation opening 112, thereby changing the internal temperature of the storage compartment.

Therefore, those skilled in the art should realize that although multiple exemplary embodiments of the present invention have been illustrated and described in detail, many other variations or modifications that accord with the principle of the present invention may be still determined or derived directly from the content disclosed by the present invention without departing from the spirit and scope of the present invention. Thus, the scope of the present invention should be understood and deemed to include these and other variations or modifications.

What is claimed is:

1. A ventilation door device for a refrigerator, comprising:

a bottom frame provided with a ventilation opening and a base plate portion, the ventilation opening disposed in the bottom frame and penetrating through the base plate portion along a direction perpendicular to the base plate portion;

a door plate abutting against the bottom frame, configured to shift along a parallel plane to the bottom frame so as to adjust an area of the ventilation opening shielded by the door plate, and having, at a side opposing the bottom frame, a guideway formed at a predetermined angle with respect to a shifting direction of the door plate; and an adjuster having a guide post protruding toward the guideway, wherein the guide post is movably inserted in the guideway, so that the guide post drives the door plate to shift when the adjuster moves in a direction perpendicular to the shifting direction of the door plate;

a front panel which is fixed on a side edge, perpendicular to a sliding groove, of the bottom frame, is perpendicular to the bottom frame and is provided with a guide opening parallel to the bottom frame, wherein the adjuster penetrates through the guide opening, such that a movement direction of the adjuster is defined by the guide opening;

wherein a wall of the guideway is formed by protruding outwards away from a surface of the door plate.

2. The ventilation door device according to claim 1, wherein the sliding groove is disposed on two opposite side edges of the bottom frame respectively to accommodate corresponding edges of the door plate.

3. The ventilation door device according to claim 1, wherein the adjuster is disposed perpendicularly to the guide opening, and has a first end provided with the guide post, and a second end extending out of the front panel.

4. The ventilation door device according to claim 3, wherein the second end of the adjuster is provided with a handle portion abutting against the front panel.

5. The ventilation door device according to claim 4, wherein a make-way opening that allows the guide post of the adjuster to pass through is disposed at one end of the guide opening.

6. The ventilation door device according to claim 1, wherein the ventilation opening is rectangular, and the door plate is rectangular and has an area larger than that of the ventilation opening; and the ventilation door device is configured to completely seal the ventilation opening when the guide post moves to a first end of the guideway, and a ventilation area of the ventilation opening is gradually increased when the guide post moves from the first end of the guideway toward a second end thereof.

7. The ventilation door device according to claim 6, wherein the guideway extends in a straight line inclined with respect to all edges of the door plate.

8. A refrigerator, comprising a storage compartment, and an air channel configured to deliver cooling air to the storage compartment, and further comprising:

at least one ventilation door device comprising:

a bottom frame provided with a ventilation opening and a base plate portion, the ventilation opening disposed in the bottom frame and penetrating through the base plate portion along a direction perpendicular to the base plate portion;

a door plate abutting against the bottom frame, configured to shift along a parallel plane to the bottom frame so as to adjust an area of the ventilation opening shielded by the door plate, and having, at a side opposing the bottom frame, a guideway formed at a predetermined angle with respect to a shifting direction of the door plate; and an adjuster having a guide post protruding toward the guideway, wherein the guide post is movably inserted in the guideway, so that the guide post drives the door plate to shift when the adjuster moves in a direction perpendicular to the shifting direction of the door plate;

a front panel which is fixed on a side edge, perpendicular to a sliding groove, of the bottom frame, is perpendicular to the bottom frame and is provided with a guide opening parallel to the bottom frame, wherein the adjuster penetrates through the guide opening, such that a movement direction of the adjuster is defined by the guide opening;

wherein a wall of the guideway is formed by protruding outwards away from a surface of the door plate;

wherein the bottom frame is disposed in the air channel, and the flow rate of the cooling air in the air channel is adjusted by adjusting a ventilation area of the ventilation opening.

9. The refrigerator according to claim 8, wherein the sliding groove is disposed on two opposite side edges of the bottom frame respectively to accommodate corresponding edges of the door plate.

10. The refrigerator according to claim 8, wherein the adjuster is disposed perpendicularly to the guide opening, and has a first end provided with the guide post, and a second end extending out of the front panel.

11. The refrigerator according to claim 10, wherein the second end of the adjuster is provided with a handle portion abutting against the front panel.

12. The refrigerator according to claim 11, wherein a make-way opening that allows the guide post of the adjuster to pass through is disposed at one end of the guide opening.

13. The refrigerator according to claim 8, wherein the ventilation opening is rectangular, and the door plate is rectangular and has an area larger than that of the ventilation opening; and the ventilation door device is configured to completely seal the ventilation opening when the guide post moves to a first end of the guideway, and a ventilation area of the ventilation opening is gradually increased when the guide post moves from the first end of the guideway toward a second end thereof.

14. The refrigerator according to claim 13, wherein the guideway extends in a straight line inclined with respect to all edges of the door plate.

* * * * *